United States Patent [19]

Ito

[11] Patent Number: 5,063,381

[45] Date of Patent: Nov. 5, 1991

[54] VESSEL RUNNING INFORMATION DISPLAY CONTROL SYSTEM

[75] Inventor: Saburo Ito, Hamamatsu, Japan

[73] Assignee: Sanshin Kogyo Kabushiki Kaisha, Hamamatsu, Japan

[21] Appl. No.: 486,250

[22] Filed: Feb. 28, 1990

Related U.S. Application Data

[63] Continuation-in-part of Ser. No. 388,684, Aug. 2, 1989, Pat. No. 4,988,996.

[30] Foreign Application Priority Data

Feb. 28, 1989 [JP] Japan ..... 1-49268

[51] Int. Cl.[5] ..... G08B 23/00

[52] U.S. Cl. ..... 340/984; 340/461; 367/107; 440/2

[58] Field of Search ..... 340/984, 987, 461, 438, 340/459, 980, 973; 367/107, 110, 111; 440/2; 364/424.01, 424.03

[56] References Cited

U.S. PATENT DOCUMENTS

| | | | |
|---|---|---|---|
| 4,035,764 | 7/1977 | Fujinami et al. | 340/459 |
| 4,109,235 | 8/1978 | Bouthors | 340/461 |
| 4,447,801 | 5/1984 | Masuda | 340/459 |
| 4,555,694 | 11/1985 | Yanagishima et al. | 340/524 |
| 4,646,059 | 2/1987 | Iwamoto et al. | 340/461 |
| 4,787,039 | 11/1988 | Murata | 340/461 |

*Primary Examiner*—Jin F. Ng
*Assistant Examiner*—Brent A. Swarthout
*Attorney, Agent, or Firm*—Ernest A. Beutler

[57] ABSTRACT

A vessel display system that is operative to provide a display both of vehicle operating conditions and extraneous operating conditions. A switching arrangement allows the operator to select either the display of the external condition except during initial operation and when there is an abnormal condition in which case the vehicle running condition is displayed or a condition wherein the vehicle running condition is continuously displayed.

3 Claims, 6 Drawing Sheets

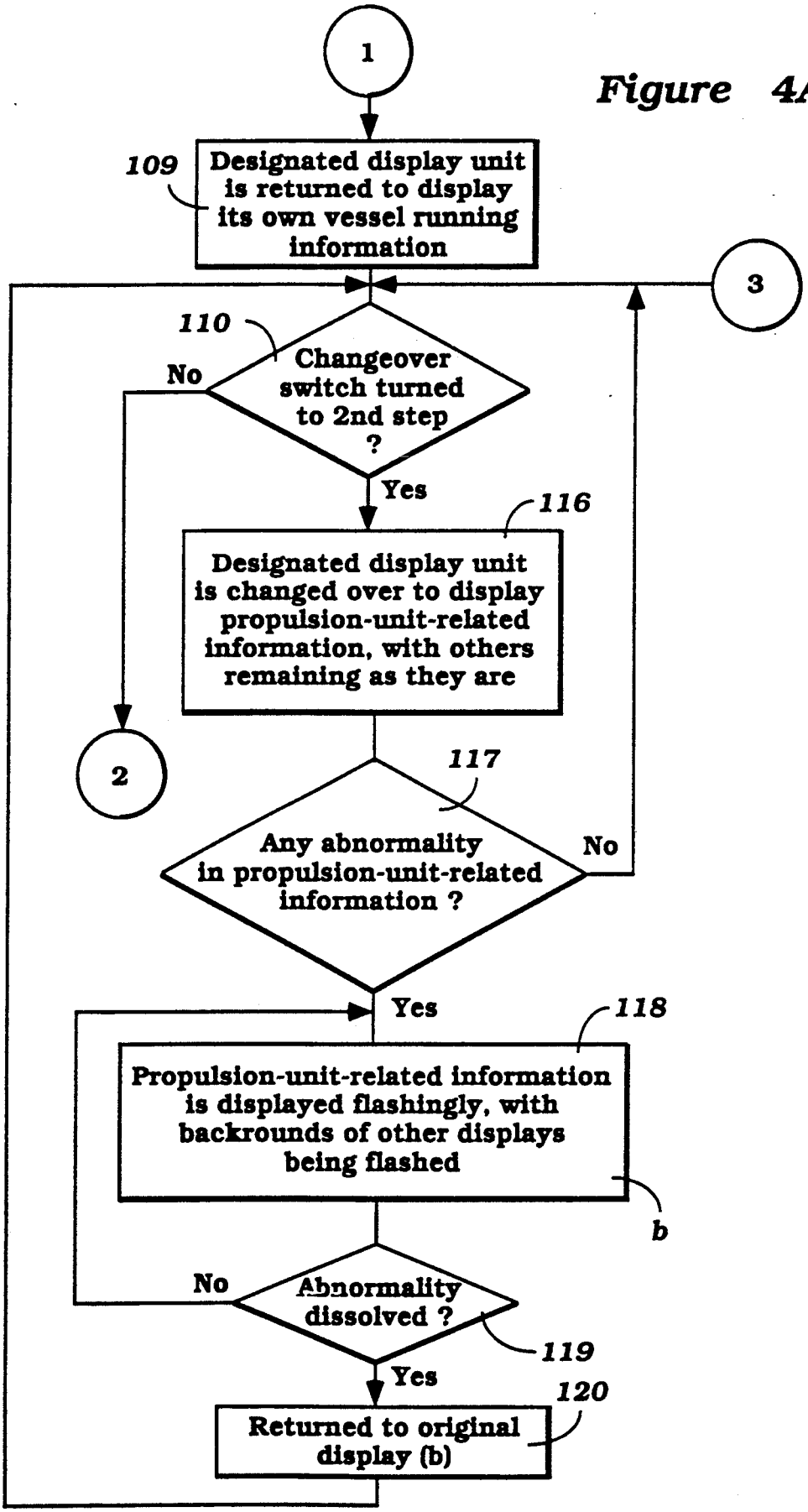
1
Figure 4A
109
Designated display unit is returned to display its own vessel running information
3
110
Changeover switch turned to 2nd step ?
No
Yes
116
Designated display unit is changed over to display propulsion-unit-related information, with others remaining as they are
2
117
Any abnormality in propulsion-unit-related information ?
No
Yes
118
Propulsion-unit-related information is displayed flashingly, with backrounds of other displays being flashed
b
No
Abnormality dissolved ?
119
Yes
120
Returned to original display (b)

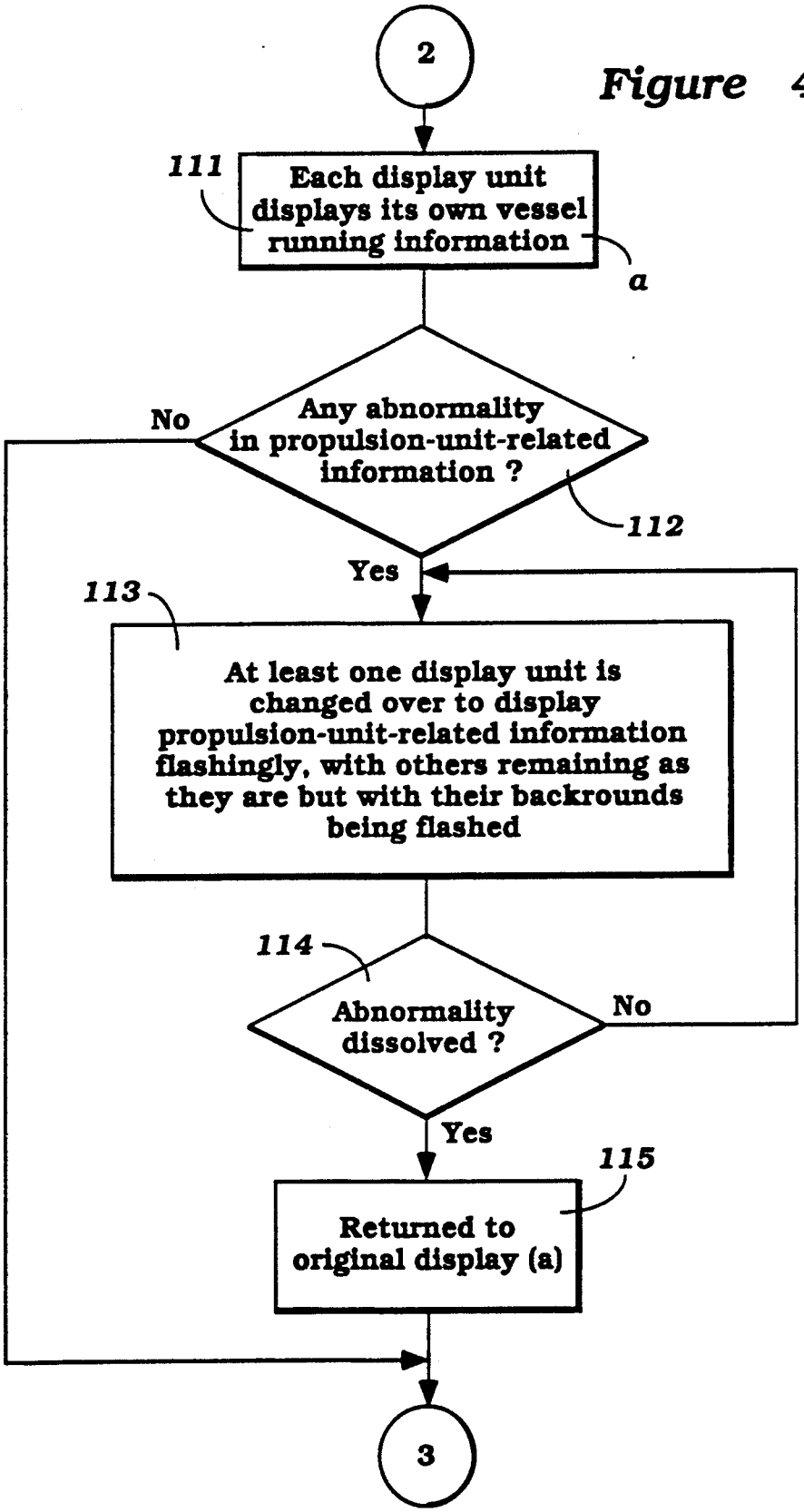
2
Figure 4B
111
Each display unit displays its own vessel running information
a
Any abnormality in propulsion-unit-related information ?
No
112
Yes
113
At least one display unit is changed over to display propulsion-unit-related information flashingly, with others remaining as they are but with their backrounds being flashed
114
Abnormality dissolved ?
No
Yes
115
Returned to original display (a)
3

VESSEL RUNNING INFORMATION DISPLAY CONTROL SYSTEM

CROSS REFERENCE TO RELATED APPLICATION

This application is a continuation in part of my application entitled "Displaying System For Fish Detector", application Ser. No. 388,684, filed Aug. 2, 1989 and assigned to the Assignee of this application, now U.S. Pat. No. 4,988,996.

BACKGROUND OF THE INVENTION

This invention relates to a vessel running information display control system and more particularly to an improved system for displaying a variety of information in a vehicle with a minimum number of display units and wherein relevant information is displayed regardless of the operator's selection under certain conditions.

It is well known that vehicles such as water vessels may be provided with a wide variety of display devices that display not only information regarding the vessel running characteristics, but also the running characteristics of the engine and, in addition, a wide variety of other signals. These other signals may include such things as ambient conditions, course of the vehicle, the detection of fish, and even television displays of television signals or signals from a VCR. Of course, as the amount of information displayed increases, the complexity of the displays also increases. In fact, at times the information accessible to the operator may be far more than he can comprehend or even has an interest in.

In my aforenoted copending application, I have disclosed a system wherein certain displays are provided on a fixed nature and other displays are provided on a variable nature. The variable display is also provided with an arrangement wherein a warning condition may be provided under some running conditions. Although that system has a wide variety of advantages, there are still further improvements which can be made.

It is, therefore, a principal object of this invention to provide an improved vessel running information display control system and an arrangement for displaying a wide variety of information, both under the operator's selection and also under certain running conditions regardless of the operator's decision.

It is a further object of this invention to provide an improved display arrangement wherein a wide variety of information can be displayed and pertinent information can be displayed when necessary and regardless of the operator's selection.

SUMMARY OF THE INVENTION

This invention is adapted to be embodied in a vehicle display system that comprises a first output device for sensing a vehicle operating condition within a normal range and an abnormal condition and provides first output signals representative thereof. A second output device provides an output signal of information other than the vehicle operating condition. Display means are provided for displaying information from either of the signals. Switch means are incorporated for enabling an operator to switch the display means from a first condition wherein the second signal is displayed except when the vehicle is first operated or when the first signal indicates an abnormal condition in which conditions the first signal is displayed and a second condition wherein the first output signal is continuously displayed.

BRIEF DESCRIPTION OF THE DRAWINGS

FIG. 4, 4*a* and 4*b* depict a block diagram showing the logic by which the display is operated.

DETAILED DESCRIPTION OF THE PREFERRED EMBODIMENTS OF THE INVENTION

Figure 1:
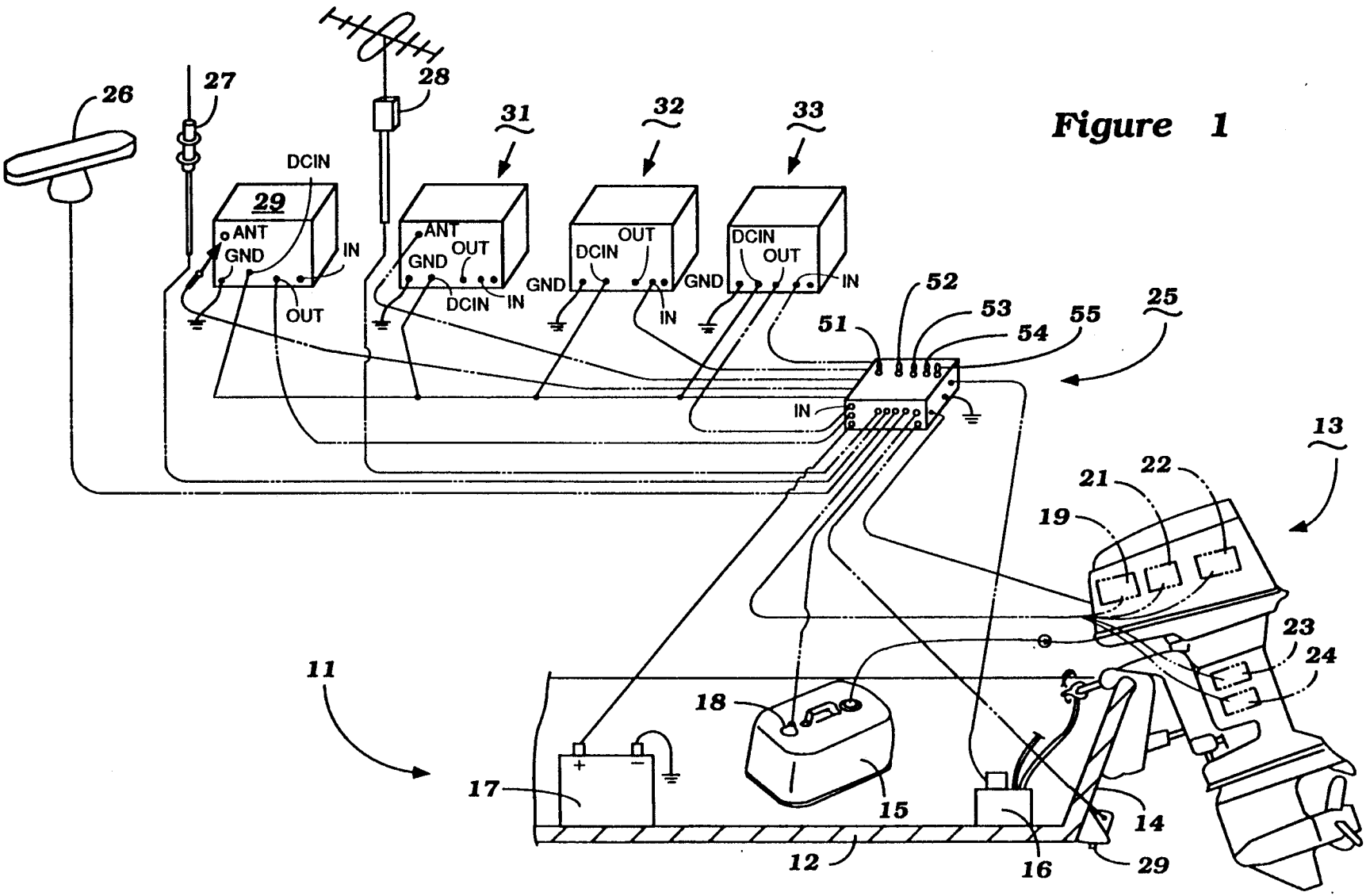
FIG. 1 is a partially schematic view of a watercraft having an information display control system constructed in accordance with an embodiment of the invention.

Referring first to FIG. 1, a watercraft is indicated by the reference numeral 11 as a typical type of vehicle in which the display incorporating the invention may be utilized. Although the invention has particular utility in watercraft, the invention may also be employed in other types of vehicles.

The watercraft 11 is comprised of a hull 12 which may be of any known type and which is powered by an outboard motor 13 that is supported in a known manner on a transom 14 of the watercraft. For operation of the outboard motor 13 there is provided a remotely positioned fuel tank 15 that is contained within the hull 12 and which supplies fuel to the power head and internal combustion engine of the outboard motor 13 in a known manner.

In addition, there is positioned within the hull 12 components of an automatic steering system such as a control unit, oil pump and control valves 16. There is further provided within the hull 12 a battery 17 for powering various devices and which may be charged from a generator driven by the outboard motor 13 and internally therein.

There are provided a number of sensors for sensing running conditions of both the outboard motor 13 and/or the watercraft 11. These sensors may be of any known type and may include sensors such as a fuel level sensor 18, which senses the level of fuel in the fuel tank 15; an oil level sensor 19, which senses the level of oil in a supply tank for the engine of the outboard motor 13; a trim angle sensor 21, which senses the trim angle of the outboard motor 13 or tilt up condition thereof; a engine speed sensor 22, which senses the rotational speed of the internal combustion engine of the outboard motor 13; a cooling water temperature sensor 23, which senses the temperature of the cooling water exiting the engine of the outboard motor 13; and a vessel speed sensor 24, which provides a dynamic water pressure signal indicative of water pressure and, accordingly, watercraft speed. The sensors 18, 19, 21, 22, 23 and 24 all output normal signals indicative of the respective sensed conditions and also can provide an abnormal condition in the event of an abnormal situation in any of the sensed conditions.

The signals sensed by the sensors 18, 19, 21, 22, 23 and 24 are all transmitted to a controller, indicated generally by the reference numeral 25 and operating on a logic as will be described.

In addition to those engine or vehicle operating condition sensors, the vessel may be provided with a wide variety of sensors for sensing external conditions other than operating conditions of the vessel. Some of these conditions may, of course, be related to the vessel running condition in some manner. However, the relationship is not a direct relationship as that provided for by the sensors as aforenoted. These sensors may include such devices as a radar antenna 26, a position detector antenna (such as a Loran C antenna) 27, a television antenna 28 and a fish detector 29. Each of the devices 26, 27, 28 and 29 provides a signal indicative of the information received thereby. This information is also transmitted to the controller 25 in a known manner by conductors. A conductor also transmits a signal between the automatic steering system 16 and the controller 25. The automatic steering system can use input signals from the radar 26 and Loran C to maintain desired courses and avoid collisions.

Figure 2:
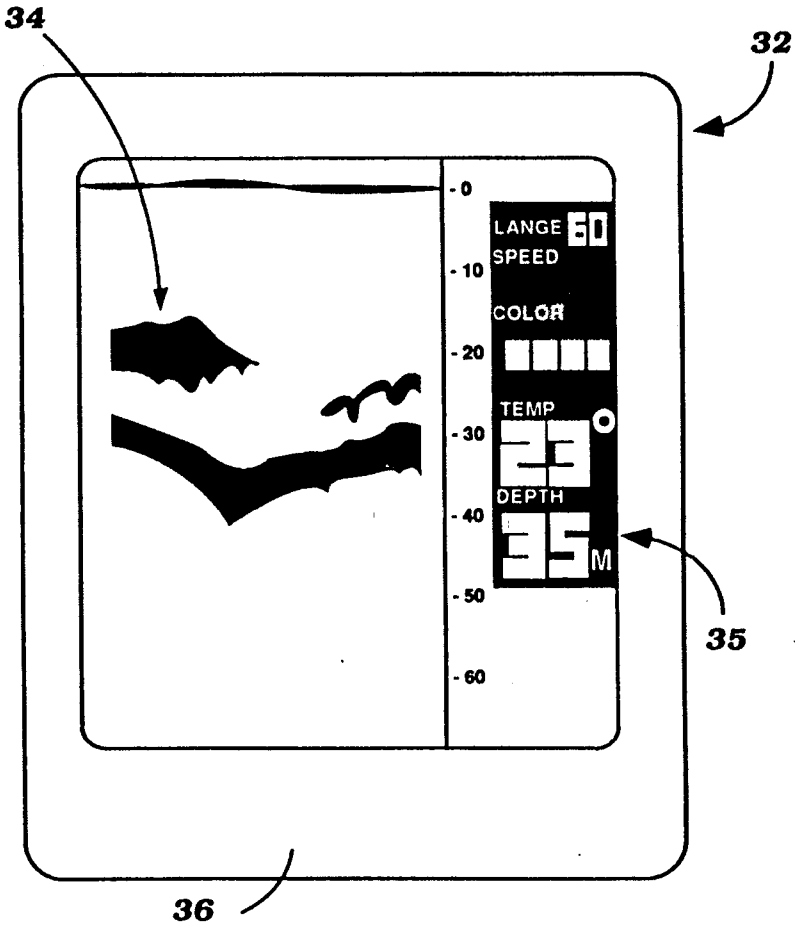
FIG. 2 is a view showing one of the displays when this display is in the condition of representing other information than vehicle information.

The watercraft 11 is also provided with one or more display units. In the illustrated embodiment, there are provided four such display units 29, 31, 32 and 33. One for each of the external information conditions such as the Loran C, television, fish detector, and radar detectors, respectively. Of course, all of the information from either the external or vessel running conditions can be displayed on a single display by multiple screens or by sequential showing For example, FIG. 2 shows two display screens for a unit such as the unit 32 which may illustrate particularly fish detector information such as a screen portion 34 that provides a graphical analysis of the fish density and depth and size, a display screen 35 that can provide other information such as range, speed, color, temperature and maximum depth. A background 36 surrounds this display.

When appropriately switched, as by the controller 25 in a manner to be described, the screen of the display 32 may provide various vessel and engine running data such as a first screen 37 that displays information such as engine speed in RPM 38, watercraft speed in KPH 39, total engine hours 41, fuel level 42 and absolute time 43. In addition, a second display 44 may include information such as lubricant level 45, battery condition such as voltage 46, water temperature of the cooling jacket 47, and watercraft information such as trim angle, distance to the nearest object, and other such information as indicated by the display 48. In addition, this display has a background 49.

Figure 4:
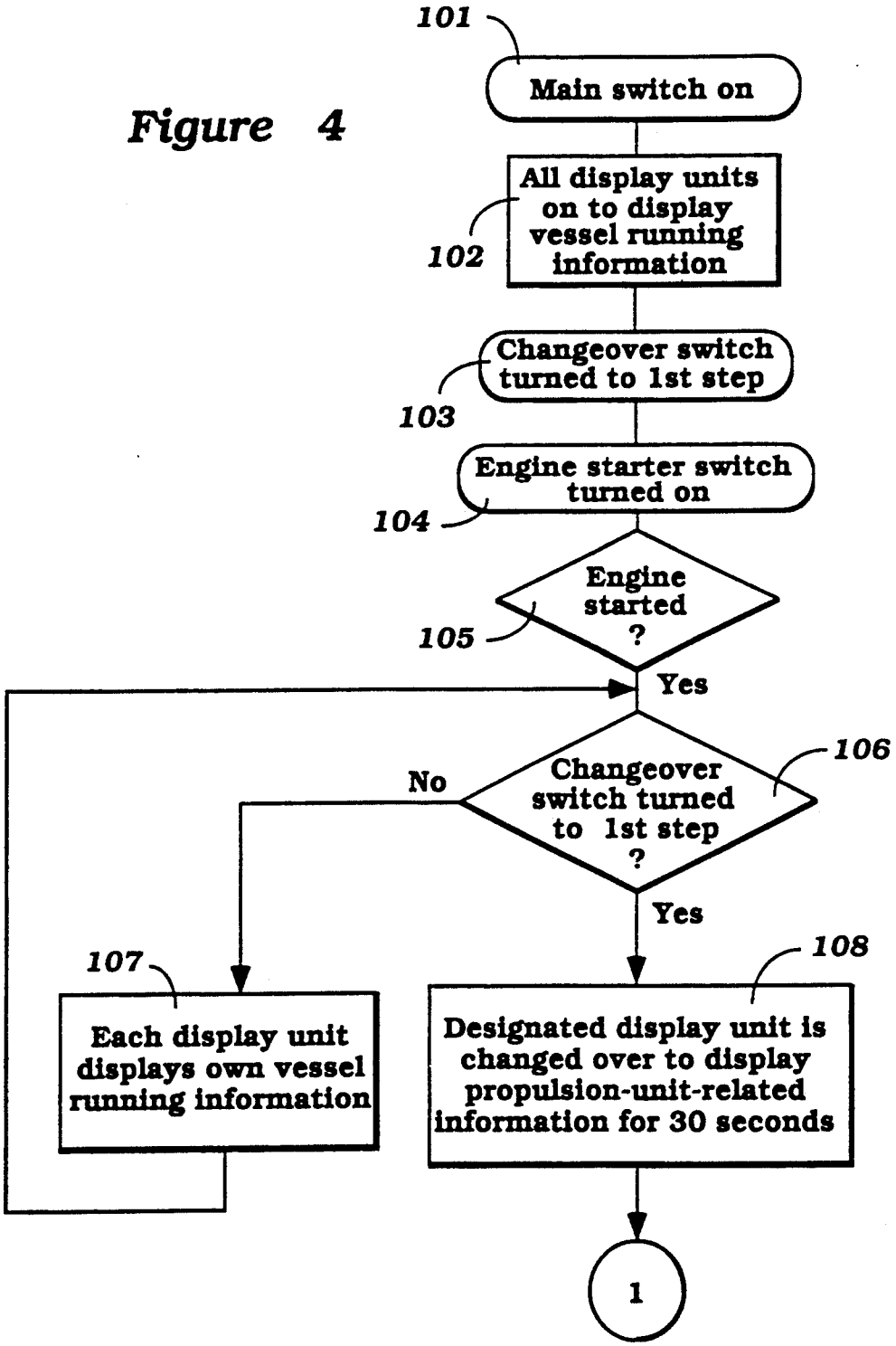

The controller selector 25 is provided with a main on/off control switch 51 and a plurality of individual selector switches 52, 53, 54 and 55. There are a number of selector control switches 52 through 54 equal in number to the number of CRT or displays 29, 31, 32 and 33. Each selector switch 52 through 55 has two positions in the illustrated embodiment. In the first condition, the non watercraft running conditions or external conditions such as the output from the Loran C 27, the television signal from the antenna 28, the fish display from the detector 29, or the radar detector from the antenna 26 will be displayed on the displays 29, 31, 32 and 33. However, the displays from the vessel running condition are displayed on the respective displays during the first thirty seconds when the engine of the outboard motor 13 is started or when any of the associated sensors 18, 19, 21, 22, 23 or 24 outputs an abnormal condition signal. In the other or second position, the associated display will display continuously watercraft operating condition data from the sensors 18, 19, 21, 22, 23 and 24. This display mode is achieved by the operation of the controller 25 which will now be described by reference to FIG. 4.

At the step 101, the main switch 51 of the controller 25 is turned on. When this occurs, at the step 102, all of the display units 29, 31, 32 and 33 will be turned on. At the step 103 the selector switches 52, 53, 54 and 55 or selected ones of them are turned to their first position to indicate normally the running characteristics of the vehicle. At the step 104 the engine starter switch is turned on and the system then begins to be operative for its countdown mode. At the step 105 it is determined if the engine has been started.

If, at the step 105 it is determined that the engine has been started, then the program moves to the step 106 so as to determine if the respective selector switch 52, 53, 54 or 55 is in its first condition mode or its second mode. If it is determined at the step 106 that the display switch is not in its first condition mode, then the program moves to the step 107 so that the vehicle running conditions will be constantly displayed. If the program moves from the step 106 to the program 107, it continues to repeat to determine at the step 106 if the switch has been moved so as to be in its first display position.

If it is determined either initially or eventually at the step 106 that the switch is in its first display mode then it moves to the step 108 to display the propulsion related information for thirty seconds. As has been previously noted, the program is initiated by operating the starter at the step 104 and this means that if the switch has been in the first display position when the engine is started, initially the vehicle running conditions will be displayed for thirty seconds.

The program then moves to the step 109 wherein the individual display is returned to display its extraneous or non vessel running condition. The program then moves to the step 110 to determine if a switch has been switched to its second or vehicle running condition display conditions. If it is not, then the program moves to the step 111 wherein the display of the individual displays which are still switched to their first position and wherein the extraneous or non vessel running conditions are displayed.

The program next moves to the step 112 wherein the controller 25 determines if any of the vessel running conditions have been displayed as indicating an abnormal condition If not, the program exits and returns back to the step 110.

If, however, it is determined at the step 112 that one of the vessel running condition sensors 19, 21, 22, 23 or 24 has sensed an abnormal condition, then the program moves to the step 113 wherein the relative display is switched over to its propulsion related information and flashes. Under this condition, the displays which do not display the abnormal running conditions will have their backgrounds 36 flashed on and off so as to provide further warning indication to the operator of an abnormal condition. In addition, other warning devices such as buzzers or lights may be sounded.

The program then moves to the step 114 to determine if the abnormal condition has been rectified. If it has not, the program exits and returns back to repeat the step 113 and keep the abnormal indicator condition being displayed. If, however, it is determined at the step 114 that the abnormal condition has been corrected, then the program moves to the step 115 and exits to return back to the step 110.

If, at the step 110 it was determined that the change-over switch was switched its second condition, then the program moves to the step 116 for the relevant display. At the step 116, the designated display is switched over to display continuously propulsion related information while the other displays will remain as they are.

The program then moves to the step 117 where it is determined if there is any abnormality in an engine running condition. If there is not, the program exits and returns back to the step 110. If, however, it has been determined at the step 117 that there is an abnormal running condition from one of the sensors, then the program moves to the step 118 wherein the propulsion unit of the abnormal condition is displayed in a flashing manner with the backgrounds of the other displays also being flashed in a manner similar to that which occurred at the step 113. The program then moves to the step 119 to determine if the abnormal condition still exists If so, the program then returns back to the step 118 and repeats.

If, however, it is determined at the step 119 that the abnormal condition has been rectified, then the device moves to the step 120 to return to the normal display and returns back to the step 110.

Figure 3:
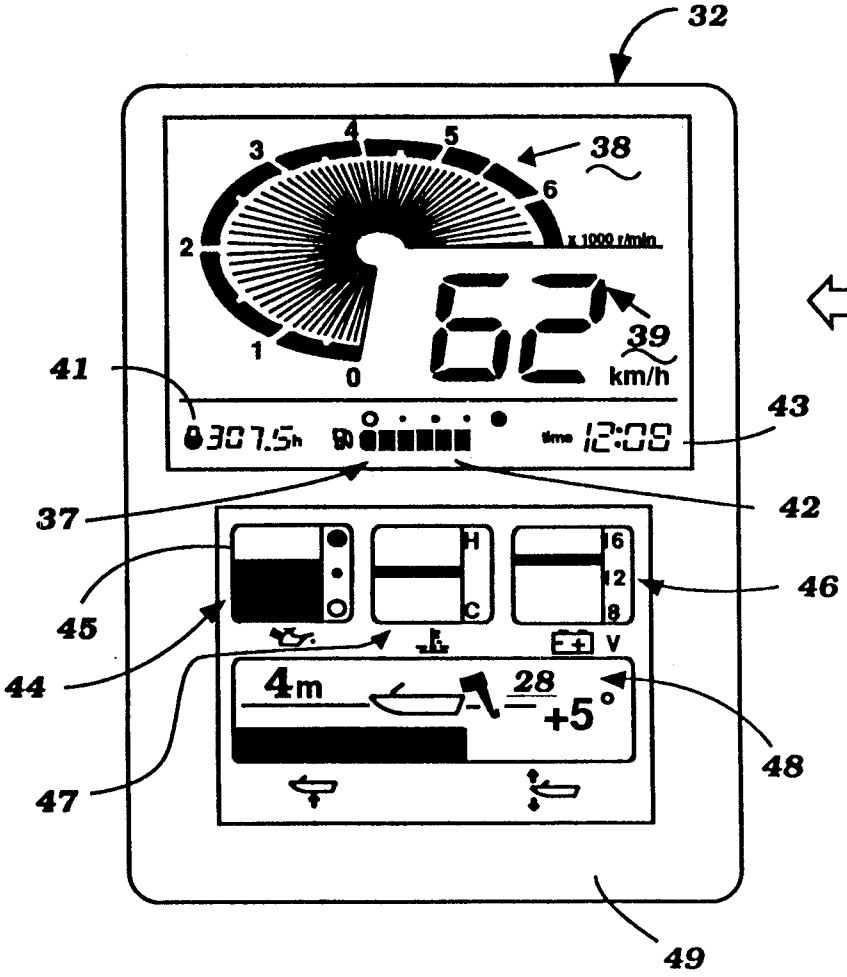
FIG. 3 is a view showing the same display when it is displaying an abnormal condition or, alternatively, when it is displaying the vessel running condition.
Figure 5:
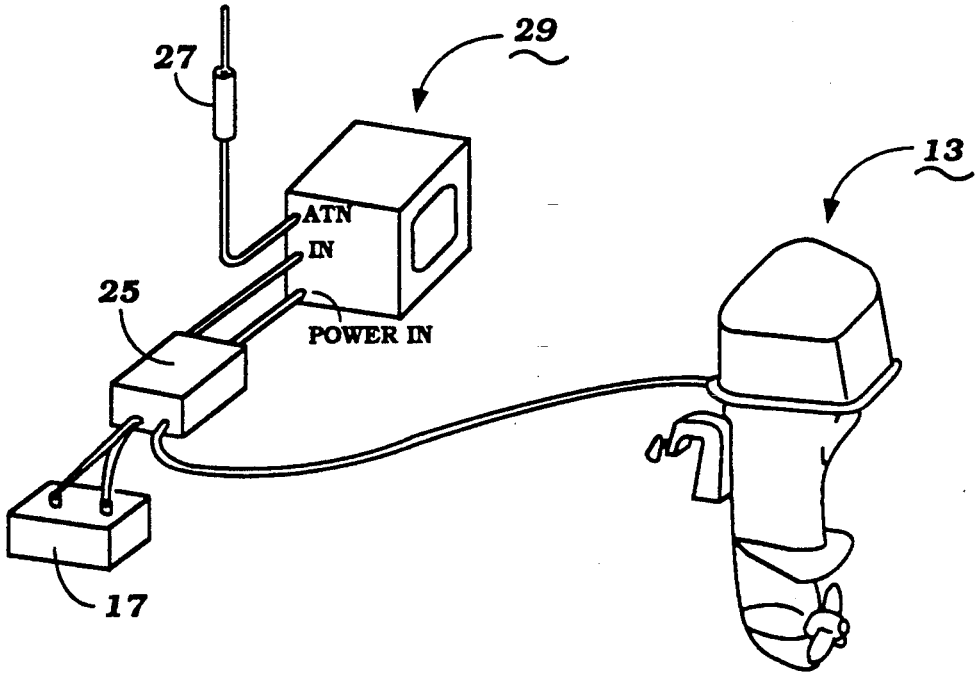
FIG. 5 is a partial perspective view showing a display system constructed in accordance with another embodiment of the invention.

In the embodiment of the invention as thus far described, all of the calculations and steps of the diagram in FIG. 3 were formed within the control unit 25. FIG. 5 shows another embodiment of the invention which is limited to the showing of the display for the Loran C 29 and its antenna 27. In this embodiment, the antenna 27 inputs directly into the display 29 and the display 29 contains some of the logic circuitry of the controller 25 so that the decision as to what information is displayed will be made by the display 29 itself.

It should be readily apparent from the foregoing description that the described embodiments of the invention permit the display of a wide variety of information from the vessel running conditions and also extraneous conditions to the operator and yet the operator will be provided with relevant information when starting up the vessel and also in the event of any abnormal condition. Of course, this description is only that of a preferred embodiment of the invention and various changes and modifications may be made without departing from the spirit and scope of the invention, as defined by the appended claims.

I claim:

1. A vessel display system comprising a first output device for sensing a vehicle operating condition within a normal range and an abnormal condition and providing first output signals representative of a normal condition within the normal range and an abnormal condition when outside of the normal range, a second output device providing a second output signal of other information than the vehicle operating condition, a single display means for displaying information from said signals, and control means for switching said display means from a first condition wherein one of the first output signals is displayed during initial vehicle operation and in the event of an abnormal condition and wherein the second output signal is displayed at all other times and a second condition wherein one of the first output signals is displayed at all times.

2. A vessel display system as set forth in claim 1 wherein there are a plurality of additional second output devices each providing a respective output signal indicative of information other than vehicle information other than the other information supplied by said second output device, and a plurality of additional displays each receiving and displaying a respective one of the second output device signals, a plurality of additional first output devices sensing vehicle operating conditions other than that sensed by the first mentioned first output device and displayed on a respective one of said additional displays.

3. A vessel display system as set forth in claim 2 wherein only the abnormal condition is displayed on a given display in the event of an abnormal condition sensed by a respective first output device, and means for causing the other displays also to provide a warning signal while continuing to provide the output of the respective second output signal so long as their associated first output device does not have an abnormal condition.

* * * * *